US006390559B1

(12) United States Patent
Schnitzhofer

(10) Patent No.: US 6,390,559 B1
(45) Date of Patent: May 21, 2002

(54) INFLATABLE SEAT

(76) Inventor: Josef Peter Schnitzhofer, Sonnhalb 37, A-5511, Hüttau (AT)

( * ) Notice: Subject to any disclaimer, the term of this patent is extended or adjusted under 35 U.S.C. 154(b) by 0 days.

(21) Appl. No.: 09/743,504

(22) PCT Filed: Jul. 7, 1999

(86) PCT No.: PCT/AT99/00171

§ 371 Date: Jan. 11, 2001

§ 102(e) Date: Jan. 11, 2001

(87) PCT Pub. No.: WO00/03626

PCT Pub. Date: Jan. 27, 2000

(30) Foreign Application Priority Data

Jul. 13, 1998 (AT) ..... 469/98 U

(51) Int. Cl.[7] ..... A47C 7/02

(52) U.S. Cl. ..... 297/452.41; 297/226

(58) Field of Search ..... 297/452.41, DIG. 3, 297/219.1, 226, 183.1, 183.9, 183.6, 452.21

(56) References Cited

U.S. PATENT DOCUMENTS

| | | | | |
|---|---|---|---|---|
| 3,511,503 | A | * | 5/1970 | Volpe |
| 5,398,994 | A | * | 3/1995 | Thomas |
| 5,690,389 | A | | 11/1997 | Ekman et al. |

FOREIGN PATENT DOCUMENTS

| | | | |
|---|---|---|---|
| AT | 001995 | | 3/1998 |
| DE | 4331369 | | 3/1995 |
| DE | 29504519 | | 6/1995 |
| DE | 4445176 | | 6/1996 |
| DE | 19623594 | | 5/1997 |
| EP | 563820 | * | 3/1993 |
| EP | 0870444 | | 10/1998 |

* cited by examiner

*Primary Examiner*—Milton Nelson, Jr.
(74) *Attorney, Agent, or Firm*—Dykema Gossett PLLC

(57) ABSTRACT

An inflatable seat, especially a ball-shaped seat, that includes an air-tight envelope surrounding a cavity filled with a gaseous medium such as air or gas, and a removable cover over the outer surface of the envelope which defines an opening for a portion of the outer surface to contact a flooring surface.

8 Claims, 1 Drawing Sheet

INFLATABLE SEAT

BACKGROUND OF THE INVENTION

The invention relates to an inflatable seat, and more specifically to a ball-shaped seat.

Inflatable ball-shaped seats customarily consist of a gas or air-impermeable material, such as plastic, rubber or the like, are filled with air or gas and are used as ergonomic seats for working at a desk for example. Nevertheless, since it is the inherent function of the envelope of the ball-shaped seat not to allow air to pass through, thus not to be breathable, seating comfort is strongly restricted when used over an extended period of time. Another disadvantage is that because of its shape, the ball-shaped seat tends to roll away when not in use and in particular when the bottom surface on which it is standing is not horizontal.

DE-A 43 31 369 discloses a chair consisting of a ring and of a ball designed for sitting on, which is supported by said ring. The ball can be secured against falling down and rolling away by a coating. A similar solution is disclosed in U.S. Pat. No. 5,690,389, in which a ball-shaped body is fastened to a support. AT-U1995 also describes a chair having a ball fastened to the stand of a swivel chair. All these solutions have in common that the corresponding under-structure is complicated and that seating comfort is not optimized.

It is the object of the invention to avoid these drawbacks and to achieve, on an inflatable seat of the type mentioned above, a simple structure while enhancing seating comfort.

SUMMARY OF THE INVENTION

The object of the invention is achieved with an inflatable ball-shaped seat formed of an envelope containing a gaseous medium, and a removable multilayered cover on the envelope, the cover defining an opening which enables a dome-shaped contact surface of the envelope to rest on a flooring surface. The materials of the cover are breathable. By using materials which are breathable and regulate the body climate, perspiration is considerably reduced, and subjective seating comfort is increased. Concurrently, rolling away is prevented from happening without having to provide a particular understructure. Moreover, the envelope may be readily withdrawn through the opening when the ball is deflated.

Seating comfort can be increased even further when the cover consists of several layers. In a particularly preferred embodiment of the invention, the cover is therefore provided with an inner lining and an outer skin, a filling being preferably arranged between the inner lining and the outer skin. The outer skin of the cover advantageously is fabricated from leather, fabric or any other material which is breathable and regulates the body climate. A material which is breathable and regulates the body climate, preferably inwoven sheep's wool, is used for the filling too. The inner lining may be made of fabric and its primary function is to achieve a good bond between the cover and the envelope of the ball-shaped seat.

In another embodiment of the invention there may be provided that the cover surrounds the envelope of the seat except for a dome-shaped contact surface of the seat's envelope. Thanks to the dome-shaped sparing of the cover in the area of the contact surface of the seat, a good bond with the bottom surface is achieved. It is particularly advantageous when the cover is provided with a ring-shaped reinforcement which is preferably accommodated in the area of the rim on the boundary to the dome-shaped contact surface. The ball-shaped seat may thus be efficiently prevented from unintentionally rolling away. The ring-shaped reinforcement is thereby provided with an inserted, preferably ring-shaped border-strengthening means which is preferably made of leather, rubber or plastic.

The invention will be described more explicitly in the following with the help of the drawings.

DETAILED DESCRIPTION OF THE PREFERRED EMBODIMENT

Figure 1:
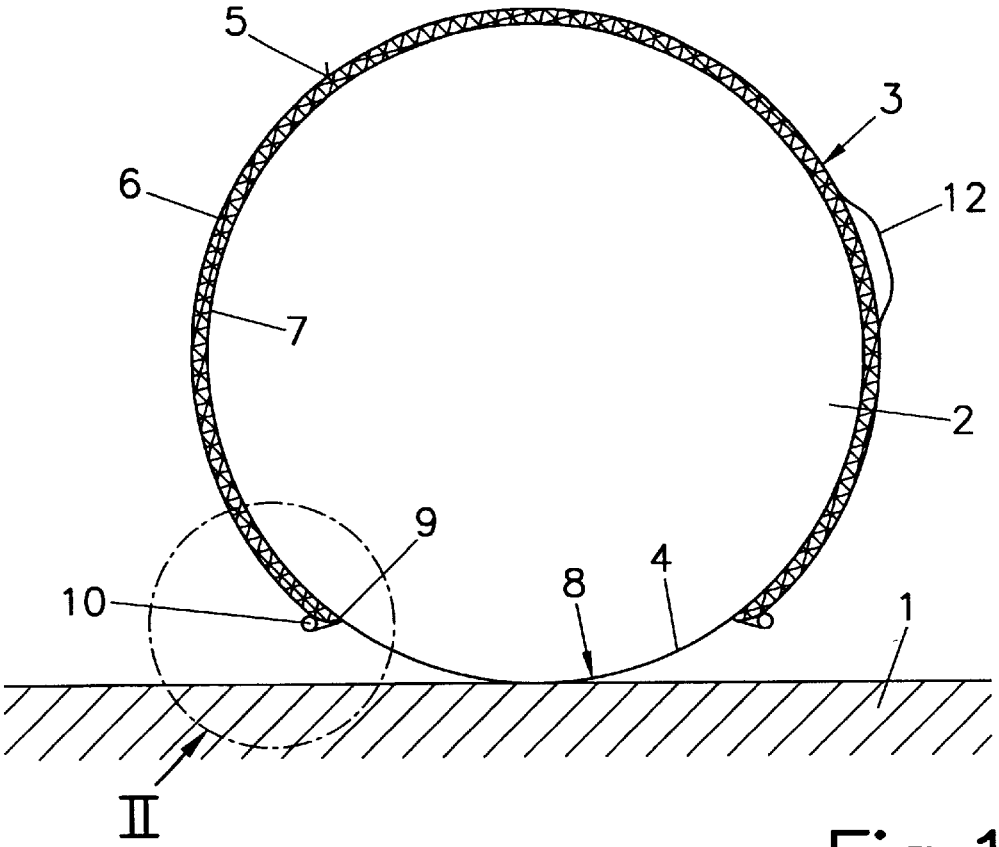
FIG. 1 shows a longitudinal section through a seat in accordance with the invention and FIG. 2 shows detail II of FIG. 1.
Figure 2:
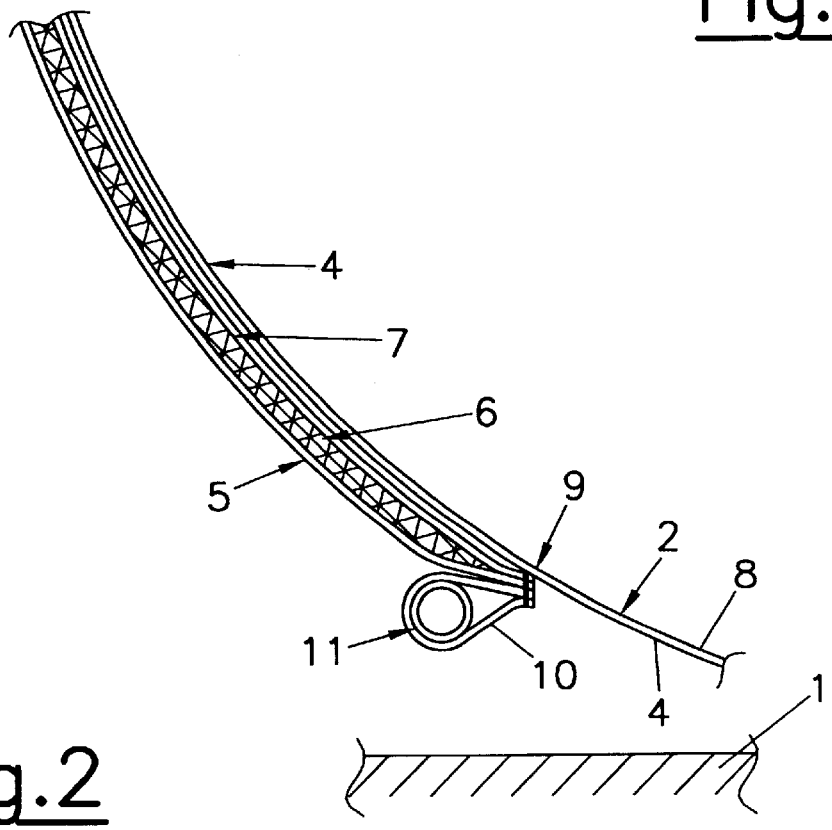

The ball-shaped seat 2 constituting the seat rests on a bottom surface 1 and is provided with a cover 3 which is removably connected to the envelope 4.

The cover 3 consists of an outer skin 5, a filling 6 and an inner lining 7. The material used for the outer skin 5 and the filling 6 is a material which is breathable and regulates the body climate, leather or fabric for the outer skin and inwoven sheep's wool for the filling 6 having proved to be particularly appropriate. Advantageously, the inner lining 7 is made of fabric. The cover 3 surrounds the ball-shaped seat 2, a dome-shaped contact surface 8 of the ball-shaped seat 2 remaining uncovered. In the area of the ring-shaped rim 9 of the cover 3, a ring-shaped reinforcement 10 is provided, said reinforcement being fitted with an inserted border-strengthening means 11 made from leather, rubber or plastic for example. Thus, the ball-shaped seat is prevented from unintentionally rolling away.

Prior to filling the ball-shaped seat 2 with air or gas, the cover 3 is spread over the envelope 4. While the seat is being filled, the envelope 4 settles closely on the cover 3, a tight connection between cover 3 and envelope 4 being thus created.

If need be, the cover 3 may be easily removed by evacuating the ball-shaped seat 2.

Seating comfort may be considerably enhanced for the user by the multilayered cover 3.

Handling of the ball-shaped seat may be simplified by providing holding straps 12 which are sewn to the cover 3.

Besides the spherical shape, the seat may of course be of a cuboid or cubic shape.

What is claimed is:

1. A ball-shaped inflatable seat comprising an air-tight envelope surrounding a cavity filled with a gaseous medium, and a removable cover positioned on an outer surface of said envelope and which is adapted to the shape of said envelope, said outer cover being made at least partially of materials that are breathable and regulate body climate, said outer cover defining an opening which enables a dome-shaped contact surface of said envelope to rest on a flooring surface, the cover defining the opening in an area of said contact surface, said envelope thus resting with the dome-shaped contact surface on the flooring surface, and wherein the cover includes a ring-shaped reinforcement on a rim of the opening to delimit the dome-shaped contact surface.

2. A seat according to claim 1, wherein the ring-shaped reinforcement includes an inserted border-strengthening means which is made of a material selected from the group consisting of leather, rubber and plastic.

3. A seat according to claim 1, wherein the cover consists of several layers.

4. A seat according to claim 3, wherein said several layers consist of an inner lining, an outer skin, and a filling between the inner lining and the outer skin.

5. A seat according to claim 4, wherein the outer skin is made of a material selected from the group consisting of leather and fabric.

6. A seat according to claim 4, wherein the filling consists of woven sheep's wool.

7. A seat according to claim 4, wherein the inner lining is made of fabric.

8. A seat according to claim 4, including holding straps on the outer skin.

* * * * *